US009879697B2

(12) United States Patent
Strömmer et al.

(10) Patent No.: US 9,879,697 B2
(45) Date of Patent: Jan. 30, 2018

(54) HYDROFOIL IMPELLER

(71) Applicant: OUTOTEC (FINLAND) OY, Espoo (FI)

(72) Inventors: Ville Strömmer, Helsinki (FI); Markus Lehtonen, Lepsämä (FI); Tuomas Hirsi, Helsinki (FI); Marko Latva-Kokko, Pori (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/523,795

(22) PCT Filed: Nov. 4, 2015

(86) PCT No.: PCT/FI2015/050758
§ 371 (c)(1),
(2) Date: May 2, 2017

(87) PCT Pub. No.: WO2016/071568
PCT Pub. Date: May 12, 2016

(65) Prior Publication Data

US 2017/0306983 A1 Oct. 26, 2017

(30) Foreign Application Priority Data

Nov. 6, 2014 (FI) ..... 20145972

(51) Int. Cl.
*B01F 7/22* (2006.01)
*F04D 29/64* (2006.01)
(Continued)

(52) U.S. Cl.
CPC ..... *F04D 29/648* (2013.01); *B01F 7/00375* (2013.01); *B01F 7/22* (2013.01);
(Continued)

(58) Field of Classification Search
CPC .... B01F 7/22; B01F 7/00375; B01F 7/00341; F04D 29/043; F04D 29/181; F04D 29/648
(Continued)

(56) References Cited

U.S. PATENT DOCUMENTS 4,191,506 A * 3/1980 Packham ..... B64C 11/00 416/232
5,046,245 A * 9/1991 Weetman ..... B01F 7/001 29/889
(Continued)

FOREIGN PATENT DOCUMENTS

CN 202078873 U 12/2011
FR 1600744 A * 7/1970 ..... B01F 7/00341
(Continued)

OTHER PUBLICATIONS

International Search Report issued by the European Patent Office acting as the International Searching Authority in relation to International Patent Application No. PCT/FI2015/050758 dated Mar. 8, 2016 (4 pages).
(Continued)

*Primary Examiner* — Justin Seabe
*Assistant Examiner* — Behnoush Haghighian
(74) *Attorney, Agent, or Firm* — Robert P. Michal, Esq.; Carter, DeLuca, Farrell & Schmidt, LLP

(57) ABSTRACT

A hydrofoil impeller wherein the tip edge is straight and has a right angle with a radius extending from the central axis to the tip edge. In the central hub and in each of the blades the number of holes in each group of first and second holes is at least five. The pattern in which the holes are arranged in each of the respective groups of holes is elliptical having a center and a major axis which is substantially parallel to the radius and placed at a distance therefrom. The leading edge is, in
(Continued)

the direction of rotation, behind an imaginary radial line intersecting the central axis of the shaft and the center of the ellipse, the leading edge being at an angle of 50°±2° in relation to the radial line. The area of the blade is divided into four planar portions by three straight bends.

6 Claims, 4 Drawing Sheets

(51) Int. Cl.
*F04D 29/18* (2006.01)
*F04D 29/043* (2006.01)
*B01F 7/00* (2006.01)

(52) U.S. Cl.
CPC ..... *F04D 29/043* (2013.01); *F04D 29/181* (2013.01); *B01F 7/00341* (2013.01)

(58) Field of Classification Search
USPC .... 416/223 R, 243; 366/330.1, 330.3, 330.5, 366/270, 328.1, 325.1, 331, 27
See application file for complete search history.

(56) References Cited

U.S. PATENT DOCUMENTS 5,326,226 A * 7/1994 Wyczalkowski ... B01F 7/00341 29/889.3
5,988,604 A * 11/1999 McWhirter ..... B01F 3/0478 261/119.1
6,250,797 B1 * 6/2001 Weetman ..... B01F 3/04531 261/93
8,220,986 B2 * 7/2012 Janz ..... B01F 7/001 366/330.1
9,138,698 B2 * 9/2015 Lilja ..... B01F 7/00341
D746,883 S * 1/2016 Strommer ..... D15/138
9,334,874 B2 * 5/2016 Xia ..... B01F 7/00375
D766,658 S * 9/2016 Strommer ..... D7/376
D767,332 S * 9/2016 Strommer ..... D7/376

FOREIGN PATENT DOCUMENTS

FR 1600744 A 7/1970
JP 2005087876 4/2005
KR 100996426 B1 11/2010
WO WO 00/20109 4/2000
WO WO 2013/124539 A1 8/2013

OTHER PUBLICATIONS

Written Opinion of the International Searching Authority issued by the European Patent Office in relation to PCT/FI2015/050758 dated Mar. 8, 2016 (7 pages).
Finnish Search Report issued by the Finnish Patent and Registration Office in relation to Finnish Patent Application No. 20145972 dated May 21, 2015 (2 pages).

* cited by examiner

HYDROFOIL IMPELLER

CROSS-REFERENCE TO RELATED APPLICATIONS

This application is a National Phase Entry under 35 USC § 371 of PCT Patent Application Serial No. PCT/FI2015/050758 filed Nov. 4, 2015, which claims priority to Finnish Patent Application No. 20145972, filed Nov. 6, 2014, the disclosure of each of these applications is expressly incorporated herein by reference in their entirety.

FIELD OF THE INVENTION

The present invention relates to a hydrofoil impeller for producing fluid flow in axial direction relative to a shaft rotating around its central axis in an agitated tank.

BACKGROUND OF THE INVENTION

In prior art, e.g. document JP 2005087876 discloses a hydrofoil impeller or producing fluid flow in axial direction relative to a shaft rotating around its central axis in an agitated tank. The impeller comprises a central hub which is connected to the shaft. The central hub is in the form of a flat plate with a uniform thickness and being perpendicular to the central axis. The central hub has three groups of first bolt holes arranged to form a pattern. Three equally-spaced blades extend radially outwardly from the central hub. Each blade has a root portion. The blade is in a form of a flat plate with a uniform thickness. The root portion has a group of second bolt holes arranged in a corresponding pattern in relation to the pattern of the first bolt holes, so that the group of second bolt holes can be aligned with the group of first bolt holes and bolts can be placed through the first and second bolt holes to form bolted joints. Each blade further comprises a straight leading edge, a trailing edge and a tip edge.

The applicant of the present application has previously designed a blade of an axial flow impeller and an axial flow impeller, disclosed in WO 2013/124539 A1, the design and dimensioning of the blade having excellent characteristics in terms of flow pattern, low energy consumption, high pumping capacity, strong axial flow with a small power consumption and low shear, high pumping efficiency, scalability and low fabrication costs. However, the presented blade design is suitable for blades which are connected to the central hub by welding. Now, there has existed a need to develop a blade and an impeller which can be constructed without any welding, so that such a structure can provide for lower manufacturing costs and enhanced fatigue strength. Therefore, the attachment of the blades to the central hub by bolted joints is a desirable approach. However, the bolted joints need redesigning of the central hub, the pattern of the bolted joint attachment and the form of the blade so that an equally good performance can be achieved compared to the impeller and blade design presented in WO 2013/124539 A1.

OBJECTIVE OF THE INVENTION

The objective of the invention is to provide an impeller having excellent performance characteristics, low fabrication costs and a long fatigue life.

SUMMARY OF THE INVENTION

According to an aspect, the present invention provides a hydrofoil impeller for producing fluid flow in axial direction relative to a shaft rotating around its central axis in an agitated tank. The impeller comprises a central hub which is connected to the shaft. The central hub is in the form of a flat plate with a uniform thickness and the hub is perpendicular to the central axis. The central hub having three groups of first bolt holes arranged to form a pattern. The impeller further comprises three equally-spaced blades extending radially outwardly from the central hub. Each blade has a root portion. The blade is in a form of a flat plate with a uniform thickness. The root portion has a group of second bolt holes arranged in a corresponding pattern in relation to the pattern of the first bolt holes, so that the group of second bolt holes can be aligned with the group of first bolt holes and bolts can be placed through the first and second bolt holes to form bolted joints. Each blade comprises a straight leading edge, a trailing edge and a tip edge.

According to the invention the tip edge is straight and has a right angle with a radius extending from the central axis to the tip edge. The number of holes in each group of first and second holes is at least five, preferably eight. The pattern in which the first holes and second holes are arranged in each of the respective groups of holes is in a form of an ellipse having a center and a major axis which is substantially parallel to the radius and placed at a distance therefrom. The leading edge is, in the direction to rotation, behind an imaginary radial line intersecting the central axis of the shaft and the center of the ellipse. The leading edge is at an angle of 58°±2° in relation to said radial line. The trailing edge has two straight edge portions which are at an angle of 150°±5° to each other. The tip of said angle is located approximately in the middle of the length of the trailing edge. The tip is rounded. The area of the blade is divided into four planar portions by three straight bends. A first bend extends along the blade in a direction which is at an angle of 16°±2° in relation to the radius and, in the direction of rotation, forwards of the radius. The first bend divides the blade to said root portion and a first profile portion. The root portion and the first profile portion meet at the first bend such that that the first profile portion is angled at an angle of 16°±2° downwardly from the root portion. A second bend extends along the blade in a direction which is at an angle of 12°±2° in relation to the radius and, in the direction of rotation, backwards from the radius. The second bend divides the blade further to a second profile portion. The first profile portion and the second profile portion meet at the second bend such that that the second profile portion is angled at an angle of 10°±2° downwardly from the first profile portion. A third bend extends along the blade in a direction which is at an angle of 21°±2° in relation to the radius and, in the direction of rotation, backwards from the radius. The third bend divides the blade further to a third profile portion. The second profile portion and the third profile portion meet at the third bend such that that the third profile portion is angled at an angle of 8°±1° downwardly from the second profile portion.

The advantage of the impeller is that it is able to provide all performance benefits as the prior art impeller disclosed in WO 2013/124539 A1 with lower manufacturing costs and higher fatigue life.

In one embodiment of the hydrofoil impeller, the central hub is in the form of a triangular plate with rounded corners. Each corner has one group of first holes.

In one embodiment of the hydrofoil impeller, the length of the blade is $0.85\times R\pm0.1\times R$, wherein R is the length of the radius from the central axis to the tip edge.

In one embodiment of the hydrofoil impeller, the corner between the leading edge and the tip edge is rounded with a radius of 0.125×R±0.02×R, wherein R is the length of the radius from the central axis to the tip edge.

In one embodiment of the hydrofoil impeller, the corner between the trailing edge and the tip edge is rounded with a radius of 0.125×R±0.02×R, wherein R is the length of the radius from the central axis to the tip edge.

In one embodiment of the hydrofoil impeller, the thickness of the blade is 0.02×R±0.01×R wherein R is the length of the radius from the central axis to the tip edge.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Figure 1:
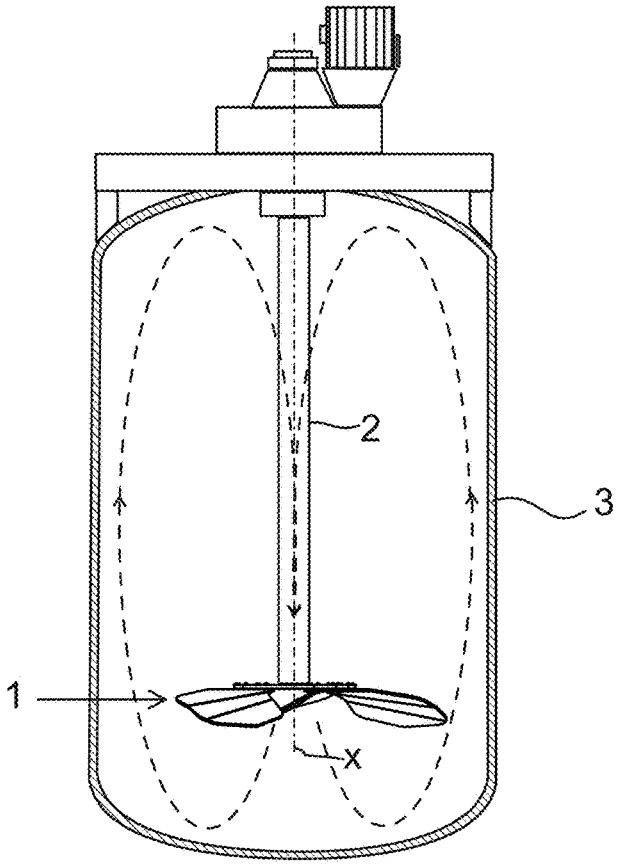
FIG. 1 is a schematic elevation side view of a reactor tank equipped with a first embodiment of the impeller in accordance of the invention.

In FIG. 1 is shown a hydrofoil impeller 1 for producing fluid flow in axial direction relative to a shaft 2 rotating around its central axis x in an agitated tank 3.

Figure 2A:
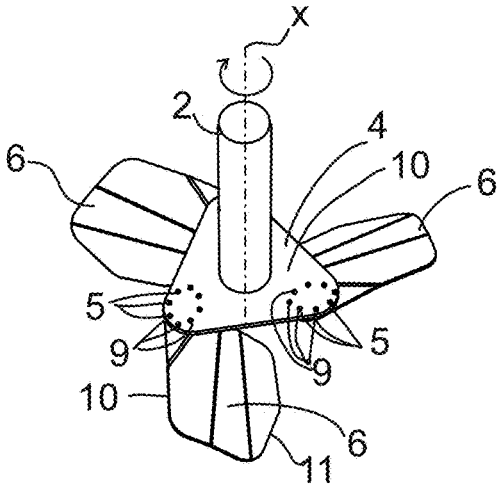
FIG. 2A is an axonometric view of the first embodiment of the impeller of the invention seen obliquely from above.
Figure 2B:
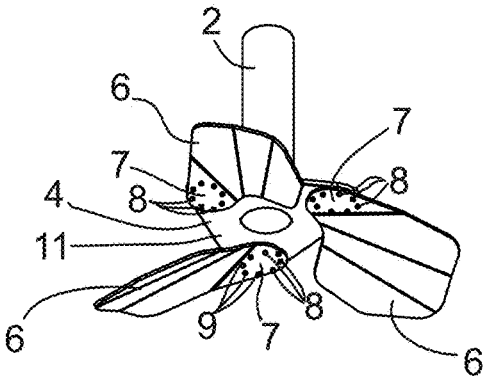
FIG. 2B is an axonometric view of the impeller of FIG. 2A seen obliquely from below.
Figure 3:
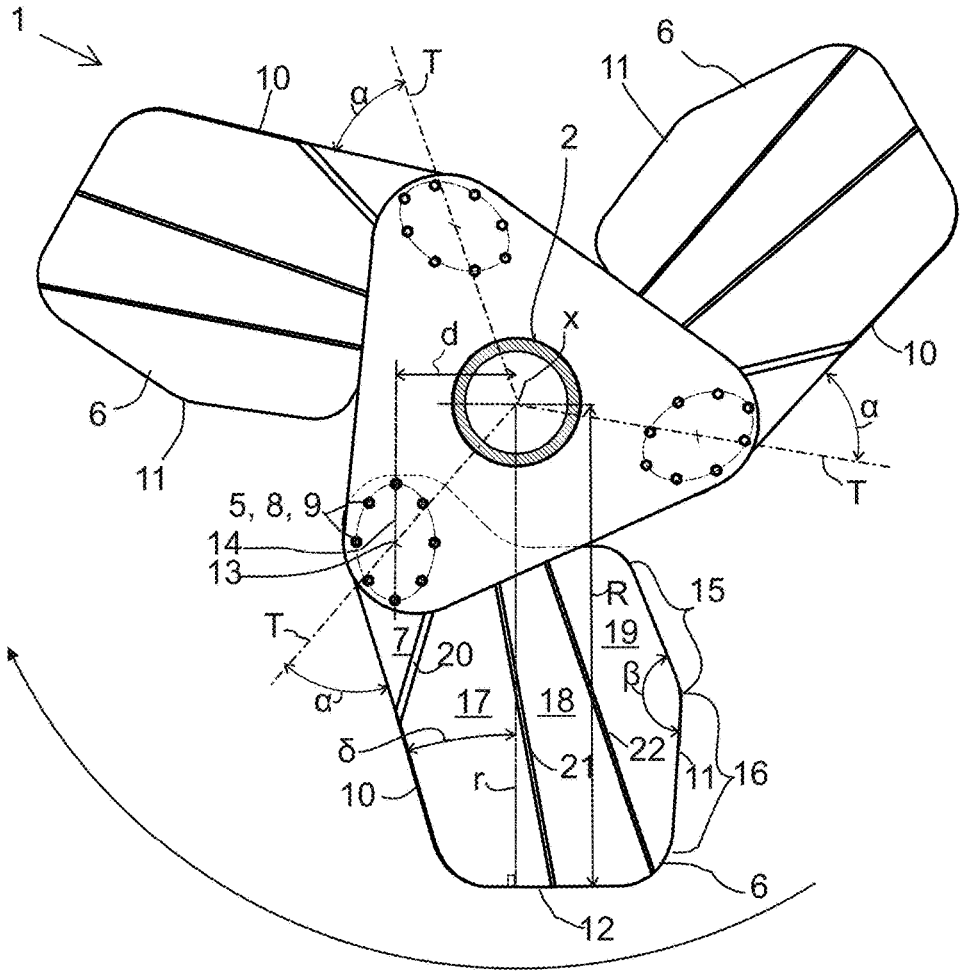
FIG. 3 shows a plan view of the impeller of FIGS. 1, 2A, and 2B seen from above.
Figure 4:
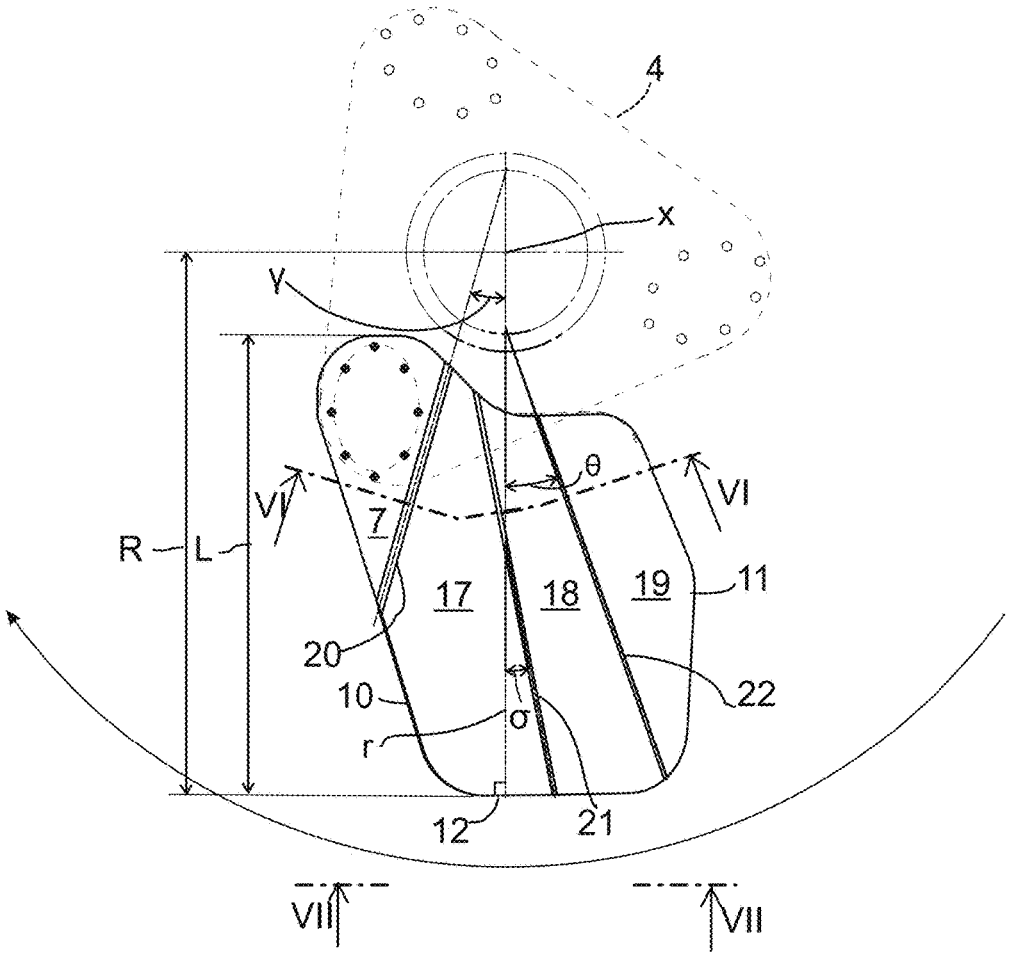
FIG. 4 is a schematic plan view showing one blade of the impeller of FIG. 3.

Referring to FIGS. 2A, 2B, and 3, the impeller 1 comprises a central hub 4. The central hub 4 is connected to the shaft 2. Preferably, the central hub 4 has a central hole to which the shaft 2 is attached by an interference fit to avoid any connecting by welding. The central hub 4 is in the form of a flat plate with a uniform thickness. The central hub 4 is perpendicular to the central axis x. The central hub 4 has three groups of first bolt holes 5 which are arranged to form an elliptical pattern. Three equally-spaced blades 6 extend radially outwardly from the central hub 4. Each blade 6 has a root portion 7. The blade 6 is in a form of a flat plate with a uniform thickness. The root portion 7 has a group of second bolt holes 8 arranged in a corresponding elliptical in relation to the elliptical pattern of the first bolt holes 5. The number of holes in each group of first and second holes 5, 8 is eight. The group of second bolt holes 8 can be aligned with the group of first bolt holes 5 and bolts 9 can be placed through the first and second bolt holes to form bolted joints. Each blade 6 comprises a straight leading edge 10, a trailing edge 11 and a tip edge 12.

As can be seen from FIGS. 2A, 2B, and 3, the central hub 4 is in the form of a triangular plate having rounded corners. One group of first holes 5 is arranged at each corner of the central hub 4. The triangular form of the central hub 4 is advantageous because it allows axial flow near to the shaft 2.

Referring to FIG. 3, the tip edge 12 of the blade 6 is straight. The tip edge 12 is at right angle in relation to a radius r which extends from the central axis x to the tip edge 12.

The elliptical pattern of the bolt holes 5 an 8 and bolts 9 has a center 13. The major axis 14 of the ellipse is substantially parallel to the radius r. The major axis 14 of the ellipse is placed at a distance d from the radius r.

The leading edge 10 of the blade 6 is, in the direction to rotation, behind an imaginary radial line T intersecting the central axis x of the shaft 2 and the center 13 of the ellipse. The leading edge 10 is at an angle $\alpha$ of 58°±2° in relation to the radial line. The leading edge 10 is also at an angle $\delta$ of 18°±2° in relation to the radius r which extends from the central axis x to the tip edge 12.

The trailing edge 11 of the blade 6 has two straight edge portions 15 and 16 which are at an angle $\beta$ of 150°±5° to each other. The tip of said angle $\beta$ is located approximately in the middle of the length of the trailing edge 11. The tip of the angle is rounded.

Reference is made to FIGS. 3, 4, and 5A-5C.

The area of the blade 6 is divided into four planar portions 7, 17, 18, 19 by three straight bends 20, 21, 22.

A first bend 20 extends along the blade 6 in a direction which is at an angle $\gamma$ of 16°±2° in relation to the radius r and, in the direction of rotation, forwards of the radius r. The first bend 20 divides the blade 6 to the root portion 7 and a first profile portion 17. The root portion 7 and the first profile portion 17 meet at the first bend 20 such that the first profile portion 17 is angled at an angle of 16°±2° downwardly from the root portion 7

A second bend 21 extends along the blade 6 in a direction which is at an angle $\sigma$ of 12°±2° in relation to the radius r and, in the direction of rotation, backwards from the radius r. The second bend 21 divides the blade 6 further to a second profile portion 18. The first profile portion 17 and the second profile portion 18 meet at the second bend 21 such that that the second profile portion is angled at an angle of 10°±2° downwardly from the first profile portion 17.

A third bend 22 extends along the blade 6 in a direction which is at an angle $\theta$ of 21°±2° in relation to the radius r and, in the direction of rotation, backwards from the radius r. The third bend 22 divides the blade 6 further to a third profile portion 19. The second profile portion 18 and the third profile portion 19 meet at the third bend 22 such that that the third profile portion 19 is angled at an angle of 8°±1° downwardly from the second profile portion 18.

Figure 5A:
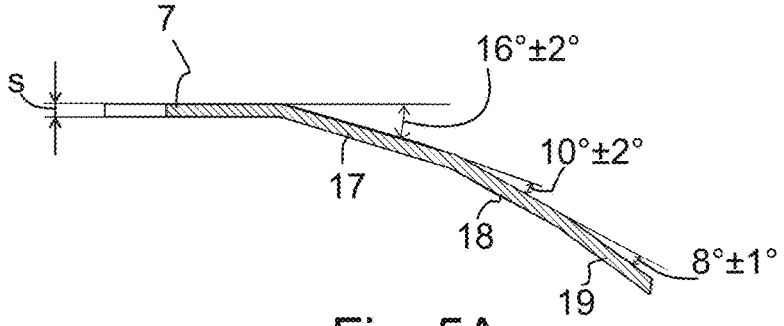
FIG. 5A is a section VI-VI from FIG. 4.
Figure 5B:
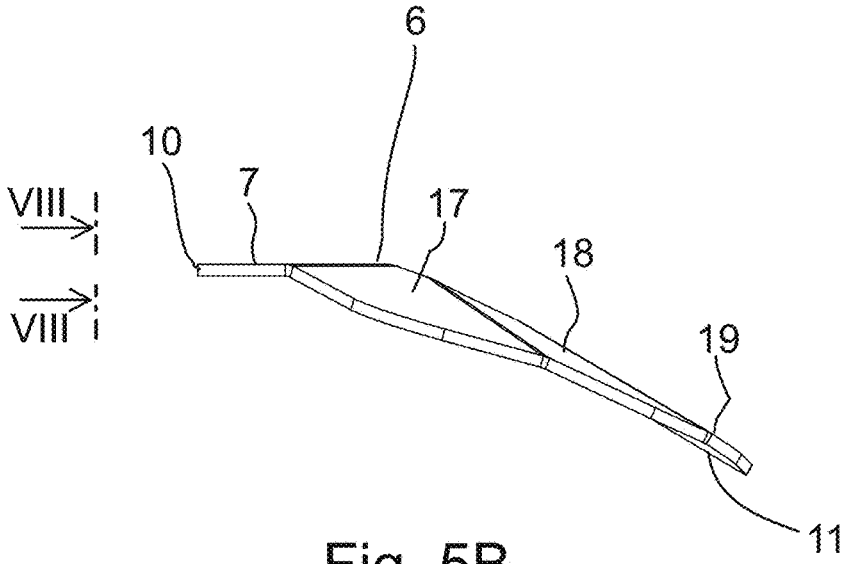
FIG. 5B is a view VII-VII from FIG. 4.
Figure 5C:
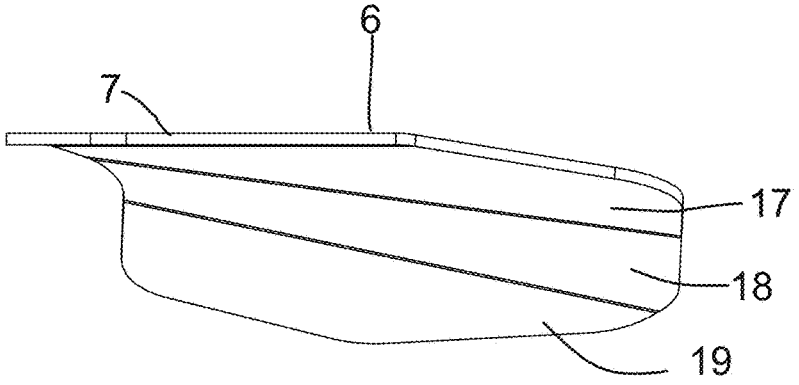
FIG. 5C is view VIII-VIII from FIG. 5B.

Referring to FIG. 3, the length L of the blade 6 is 0.85×R±0.1×R. The corner between the leading edge 10 and the tip edge 12 is rounded with a radius of 0.125×R±0.02×R. The corner between the trailing edge 11 and the tip edge 12 is rounded with a radius of 0.125×R±0.02×R. Referring to FIG. 5A, the thickness s of the plate material blade 6 is 0.02×R±0.01×R. R is the length of the radius r from the central axis to the tip edge 12.

While the present invention has been described in connection with an exemplary embodiment, and implementations, the present invention is not so limited, but rather covers various modifications, and equivalent arrangements, which fall within the purview of prospective claims.

The invention claimed is:

1. A hydrofoil impeller for producing fluid flow in an axial direction relative to a shaft rotating around its central axis in an agitated tank, said impeller comprising:

a central hub which is connected to the shaft, the shaft defining an upper portion and an opposite, lower portion, the central hub being in the form of a flat plate with a uniform thickness and being perpendicular to the central axis, the central hub having three equally spaced groups of first bolt holes, wherein each group of first bolt holes is arranged to form a pattern, three equally-spaced blades extending radially outwardly from the central hub, each blade having a root portion, said blade being in a form of a flat plate with a uniform thickness, said root portion of each blade having a corresponding group of second bolt holes arranged in a pattern corresponding to the pattern of a respective group of first bolt holes so that each group of second bolt holes can be aligned with the respective group of first bolt holes and bolts can be placed through the respective first and second bolt holes to form bolted joints, an each blade comprising a straight leading edge, a trailing edge and a tip edge, wherein:

the tip edge is straight and has a right angle with a radius extending from the central axis to the tip edge, the number of holes in each group of first and second bolt holes is at least five, the pattern in which the first bolt holes and second bolt holes are arranged in each of the respective groups of first and second bolt holes is in a form of an ellipse having a center and a major axis which is substantially parallel to the radius and placed at a distance therefrom, the leading edge is, in the direction to rotation, behind an imaginary radial line intersecting the central axis of the shaft and the center of the ellipse, said leading edge being at an angle of 50°±2° in relation to the radial line, the trailing edge has two straight edge portions which are at an angle (β) of 150°±5° to each other, a tip of said angle (β) being located at a middle portion of the length of the trailing edge, said tip being rounded, each blade defines an area that is divided into four planar portions by three straight bends which include:

a first bend extending along the blade in a direction which is at an angle (γ) of 16°±2° in relation to the radius and, in the direction of rotation, forwards of the radius, said first bend dividing the blade to said root portion and a first profile portion, the root portion and the first profile portion meeting at the first bend such that the first profile portion is angled at an angle of 16°±2° towards the lower portion of the shaft from the root portion, a second bend extending along the blade in a direction which is at an angle (σ) of 12°±2° in relation to the radius and, in the direction of rotation, backwards from the radius, said second bend dividing the blade further to a second profile portion, the first profile portion and the second profile portion meeting at the second bend such that the second profile portion is angled at an angle of 10°±2° towards the lower portion of the shaft from the first profile portion, and a third bend extending along the blade in a direction which is at an angle (θ) of 21°±2° in relation to the radius and, in the direction of rotation, backwards from the radius, said third bend dividing the blade further to a third profile portion, the second profile portion and the third profile portion meeting at the third bend such that the third profile portion is angled at an angle of 8°±1° towards the lower portion of the shaft from the second profile portion.

2. The hydrofoil impeller according to claim 1, wherein the central hub is in the form of a triangular plate with rounded corners, each corner having one group of first bolt holes.

3. The hydrofoil impeller according to claim 1, wherein the length of the blade is 0.85×R±0.1×R, wherein R is the length of the radius from the central axis to the tip edge.

4. The hydrofoil impeller according to claim 1, wherein the corner between the leading edge and the tip edge is rounded with a radius of 0.125×R±0.02R, wherein R is the length of the radius from the central axis to the tip edge.

5. The hydrofoil impeller according to claim 1, wherein the corner between the trailing edge and the tip edge is rounded with a radius of 0.125×R±0.02×R, wherein R is the length of the radius from the central axis to the tip edge.

6. The hydrofoil impeller according to claim 1, wherein the thickness of the blade is 0.02×R±0.01R, wherein R is the length of the radius from the central axis to the tip edge.

* * * * *